United States Patent [19]

Kawai et al.

[11] 4,206,729

[45] Jun. 10, 1980

[54] EXHAUST GAS RECIRCULATION SYSTEM

[75] Inventors: Noriaki Kawai, Okazaki; Heisuke Yamamoto, Toyota, both of Japan

[73] Assignee: Toyota Jidosha Kogyo Kabushiki Kaisha, Toyota, Japan

[21] Appl. No.: 881,048

[22] Filed: Feb. 24, 1978

[30] Foreign Application Priority Data

Sep. 9, 1977 [JP] Japan ..... 52-107712

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,090,482 | 5/1978 | Yoshida | 123/119 A |
| 4,142,496 | 3/1979 | Saito et al. | 123/119 A |

*Primary Examiner*—Wendell E. Burns

*Attorney, Agent, or Firm*—Finnegan, Henderson, Farabow, Garrett & Dunner

[57] ABSTRACT

An exhaust gas recirculation system for use in an internal combustion engine includes an intake manifold having a riser portion serving as a heating source for an intake mixture charge, an exhaust gas recirculation passage running from an exhaust manifold to an intake system for introducing part of exhaust gases from the former to the latter, and a temperature-responsive valve provided in the intake manifold in such a position as to be able to detect the temperature of the riser portion for controlling the flow rate of the recirculation exhaust gases, in accordance with the temperature of the riser position. In this exhaust gas recirculation system, the flow rate of exhaust gases to be recirculated from the exhaust manifold to the intake system may be increased by one step, or two steps, as required, in response to the temperature of the riser portion, by means of a modified temperature responsive valve attached to the intake system.

5 Claims, 6 Drawing Figures

EXHAUST GAS RECIRCULATION SYSTEM

BACKGROUND OF THE INVENTION

1. Field of the Invention

This invention relates to an exhaust gas recirculation system for use in an internal combustion engine, and more particularly to an exhaust gas recirculation system for use in an internal combustion engine equipped with an intake-mixture-charge heating means.

2. Description of the Prior Art

In general, a riser portion is provided on an outer wall of a collecting portion of an intake manifold of an internal combustion engine, and exhaust gases or warmed cooling water is introduced into the riser portion for heating the intake manifold, thereby preventing fuel droplets from clinging to the inner wall of the intake manifold.

On the other hand, the exhaust gas recirculation system recirculates part of exhaust gases into an intake mixture system of the engine for suppressing the generation of nitrogen oxides. In this respect, recirculation of exhaust gases exerts direct influence on the operational performance of an engine, so that the recirculation should be controlled so as not to impair desired drivability of a motor vehicle powered by the engine. To meet this requirement, it has been proposed to provide a temperature-responsive valve on a water jacket in a prior art exhaust gas recirculation system, and the flow rate of exhaust gases to be recirculated is controlled in association with the temperature of the cooling water. However, with such a prior art exhaust gas recirculation system, exhaust gases are recirculated, despite the fact that the engine may remain in an instable condition, so that the operational performance of an engine is adversely affected. This is particularly true when starting a cold engine.

SUMMARY OF THE INVENTION

It is, therefore, an object of the present invention to provide an exhaust gas recirculation system for use in an internal combustion engine equipped with an intake-mixture-charge heating device, which includes apparatus for exhaust gas recirculation, while retaining desired operational performance of the engine.

It is another object of the present invention to provide an exhaust gas recirculation system for use in an internal combustion engine of the type described, which may vary the flow rate of exhaust gases being recirculated, in a desired pattern, such as by one step, or two steps, according to the temperature of a riser portion of the intake manifold of the engine.

The present invention is based on the discovery that the operational performance of an engine does not depend on the warm-up condition of the engine but on the atomized condition of fuel supplied to the engine. In the past, it has been agreed that the desired atomized condition of the fuel cannot be achieved in a cold-starting condition of the engine but can be achieved only in a warm-up condition of an engine. However, the temperature of the engine does not exactly respond to the atomized condition of fuel. For instance, in case the intake mixture charge is cold, then a poor atomized condition of fuel will result, despite the warm-up condition of an engine. Even if the engine is encompassed with a water jacket, so that the engine is generally warmed up relatively quickly, the carburetor and the intake manifold warm up more slowly because of the presence of cold air therein, thus resulting in a poor atomized condition of a mixture charge. With an internal combustion engine equipped with an intake-mixture-charge-heating device, the atomized condition of fuel is particularly associated with the temperature of the riser portion of the manifold heating the charge. In this sense, according to the present invention, the flow rate of exhaust gases being recirculated is controlled relative to the temperature of a riser portion of the intake manifold.

According to the present invention, there is provided an exhaust gas recirculation system for use in an internal combustion engine equipped with an intake-mixture-charge-heating device, which comprises: an intake manifold having a riser portion for heating the intake mixture charge, and means for controlling the flow rate of exhaust gases from the exhaust manifold through an exhaust gas recirculation passage to the intake system in response to the temperature of the riser portion of the intake manifold.

DESCRIPTION OF THE PREFERRED EMBODIMENTS

The present invention will now be described in more detail with reference to the accompanying drawings.

Figure 1:
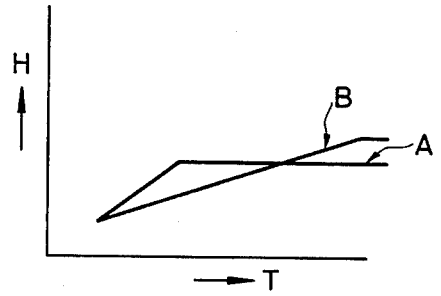
FIG. 1 is a graph representing the relationship between temperatures of cooling water in an engine water jacket, a riser portion of the intake manifold and time.

FIG. 1 shows the relationship between the temperatures H of cooling water A in the water jacket of an internal combustion engine and riser portion B of the intake manifold, versus the time T. As shown, there is considerable difference in temperature rise in the water and the riser B.

Figure 2:
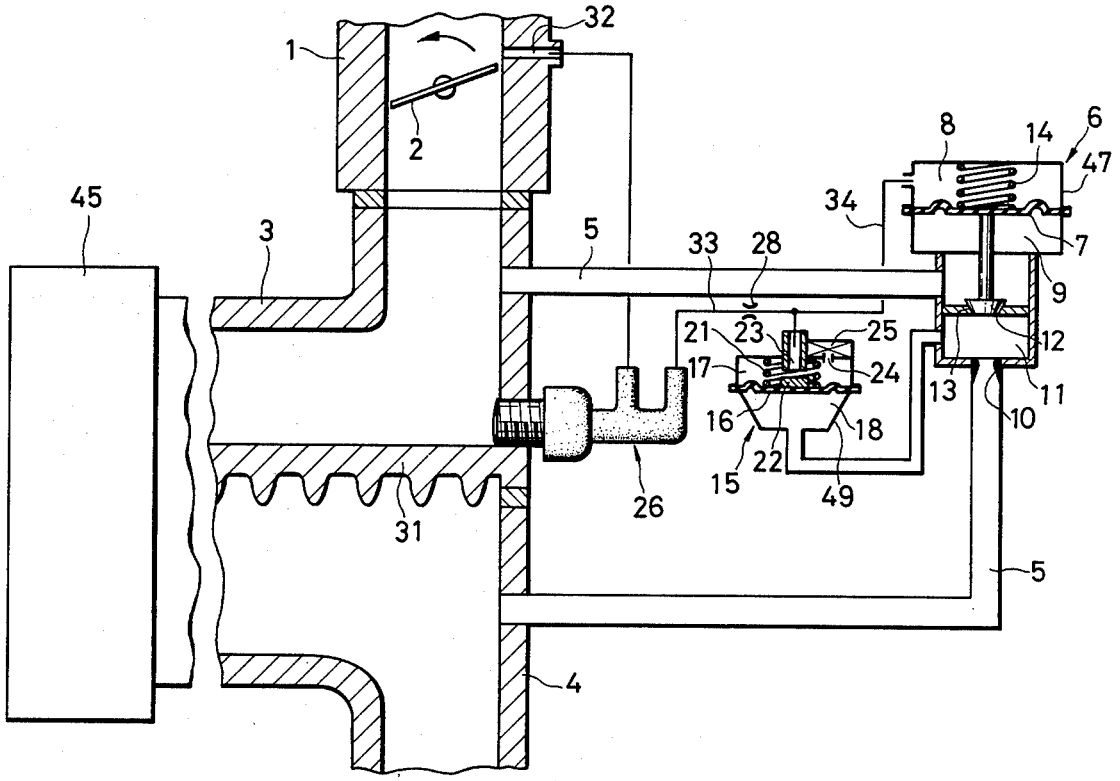
FIG. 2 is a schematic view of one embodiment of the exhaust gas recirculation system of the invention for use in an internal combustion engine equipped with an intake-mixture-charge heating device such as a riser portion of the intake manifold.

In FIG. 2 there is shown a carburetor 1 and a throttle valve 2 positioned in an air horn of the carburetor of an internal combustion engine 45. The engine 45 also includes a conventional intake manifold 3 and exhaust manifold 4.

An exhaust gas recirculation (EGR) passage 5 runs from the exhaust manifold 4 to the intake manifold 3 and an EGR control valve 6 is provided on the EGR passage. The EGR control valve 6 includes a diaphragm 7 which divides the interior of a valve housing 47 of the valve 6 into a vacuum chamber 8 and an atmospheric pressure chamber 9. Valve body 12 opens and closes a valve port 13 in response to the movements of the diaphragm 7 to which the valve body is coupled. A spring 14 loads the diaphragm 7 for biasing it toward the atmospheric pressure chamber 9. In addition, the EGR control valve 6 includes an orifice 10 between the valve port 13 and the exhaust manifold 4 while the constant pressure chamber 11 is defined between the orifice 10 and the valve port 13. It is apparent that exhaust gases are only recirculated through the passage 5 when the valve port 13 is opened by vacuum pressure in the vacuum chamber 8.

A vacuum-regulating valve 15 includes: a diaphragm 16, which divides the interior of a valve housing 49 of the valve 15 into an atmospheric-pressure chamber 17, and a control chamber 18; a spring 21 loading the diaphragm 16 for biasing it toward the control chamber 18; and a valve body 22 coupled to the diaphragm 16 for opening and closing a port 23 in the atmospheric-pressure chamber 17 in accordance with the movement of the diaphragm.

The atmospheric-pressure chamber 17 communicates through a port 24 and a filter 25 to the atmosphere.

Figure 3:
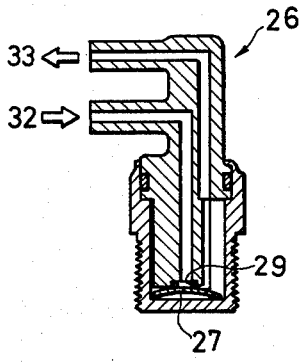
FIG. 3 is a detailed view of a bi-metal type temperature-responsive valve for use in the embodiment of FIG. 2.

A bi-metal type temperature-responsive valve 26 is so designed as to open and close a passage due to deformation or bending of a bi-metal disc 27 as shown in FIG. 3, the passage being closed when the temperature of the disc is below a predetermined temperature T1. The bi-metal type temperature-responsive valve 26 is attached to the intake manifold 3 in a position suitable to detect the temperature of a riser portion 31. The riser portion 31 is located on a portion of the intake mixture-charge passage, which turns its direction from the vertical to the horizontal. The riser portion 31 belongs to a collecting portion of the intake manifold 3.

Stated differently, the riser portion 31 is formed on a portion of the intake manifold 3, where fuel droplets are likely to be collected and is also in contact with the exhaust gases within the exhaust manifold 4.

An EGR port 32 is positioned in the air horn of the carburetor 1 in such a position thereof which may be exposed to a vacuum or an atmospheric pressure, depending on the amount of opening or closing of the throttle valve 2. The EGR port 32 communicates with the vacuum chamber 8 in the EGR control valve 6 via the temperature-responsive valve 26 through a passage 33, 34. The passage 33, 34 is connected to the port 23 in the vacuum-regulating valve 15. The control chamber 18 in the vacuum-regulating valve 15 is connected to the constant-pressure chamber 11 in the EGR control valve 6. The portion of the passage 33, 34 running from the temperature-responsive valve 26 to the port 23 is referred to as passage portion 33, while the portion of the passage running from the port 23 to the vacuum chamber 8 is referred to as a passage portion 34. An orifice 28 is provided on the passage portion 33 for preventing the introduction of atmospheric pressure from the atmospheric pressure chamber 17 into the EGR port 32.

The vacuum-regulating valve 15 maintains an exhaust gas pressure in the constant pressure chamber 11 in the EGR control valve 6 substantially constant (at atmospheric pressure), thereby preventing the ratio in the flow rates of the air-fuel mixture charge to the recirculating exhaust gases from being affected by a vacuum in the intake manifold. More particularly, when the pressure of exhaust gases in the constant pressure chamber 11 exceeds a given pressure level, then the diaphragm 16 in the vacuum-regulating valve 15 is deflected towards the atmospheric pressure chamber 17 against the action of spring 21, so that the port 23 is closed by the valve body 22. As a result, any vacuum in the passage portion 33 is introduced intact via the passage portion 34 to the vacuum chamber 8 of the EGR control valve 6, without being affected by an atmospheric pressure, so that the valve port 13 being opened, then the diaphragm 16 in the vacuum-regulating valve 15 is forced towards the control chamber 18 under the action of the spring 21, so that the port 23 is opened. By this action, the vacuum in the passage portion 33 is delivered through the port 23 to atmosphere, so that the vacuum in the vacuum chamber 8 approaches atmospheric pressure. The valve port 13 is then closed, and the exhaust gas pressure in the constant pressure chamber 11 begins to build up again. In this manner, the opening and closing operations of the valve body 12 are continually repeated so that exhaust gas pressure in the constant pressure chamber 11 may be maintained substantially constant.

When the engine is under a load below a given level, i.e., when the throttle valve 2 is sufficiently closed as to be positioned downstream of the EGR port 32, then atmospheric pressure prevails at the port 32. In this case, a vacuum is not introduced into the vacuum chamber 8 in the EGR control valve 6 regardless of the opening and closing conditions of the temperature-responsive valve 26, so that the valve port 13 is closed and exhaust gases are not recirculated.

When the engine is under a load above a given level, i.e., when the throttle valve 2 is sufficiently opened as to be positioned upstream of the EGR port 32, a vacuum prevails at the port 32. When the temperature of riser portion 31 remains below the given temperature T1, then poor atomization of fuel results. In this condition, the bi-metal disc 27 in the temperature-responsive valve 26 is bent and urged against an O-ring 29, closing the valve 26 so that the vacuum is not introduced through the EGR port 32 into the passage 33, 34. In this case, as well, a vacuum is not supplied to the vacuum chamber 8 in the EGR control valve 6, so that exhaust gases are not recirculated. Accordingly, the performance of the engine may be prevented from the adverse effect due to exhaust gases being recirculated.

When the riser portion 31 is above the given temperature T1, satisfactory atomization of fuel may be achieved, and the operation of an engine is relatively stable. At this time, the bi-metal disc 27 in the temperature responsive valve 26 is bent in the direction opposite to the O-ring 29, thereby opening the valve 26, so that any vacuum at the port 32 is introduced into the passage 33, 34. In this manner, the EGR passage 5 is opened, and exhaust gases are supplied to the intake manifold 3 through the valve port 13.

Figure 4:
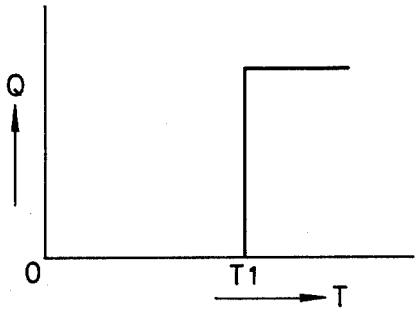
FIG. 4 is a graph representing the relationship between riser temperature and the flow rate of exhaust gases being recirculated in the embodiment of FIG. 2.

FIG. 4 shows the relationship between the temperature T of the riser portion 31 and the flow rate Q of exhaust gases being recirculated, in the embodiment of FIG. 2.

Figure 5:
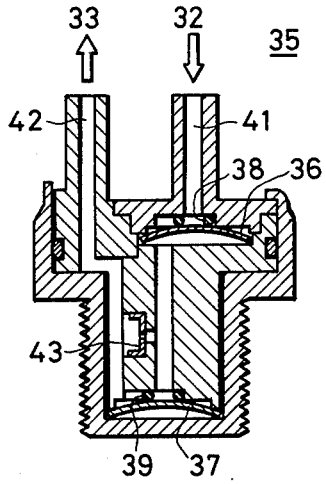
FIG. 5 is a detailed view of a modified temperature-responsive valve for use in another embodiment of the present invention.
Figure 6:
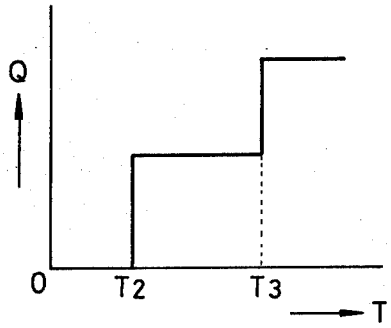
FIG. 6 is a graph representing the relationship between a riser temperature and the flow rate of exhaust gases being recirculated, in the temperature-responsive valve of FIG. 5.

In accordance with the invention, the relationship between the temperature T of the riser portion and the flow rate Q of exhaust gases being recirculated may be increased in two steps as shown in FIG. 6, by using a temperature-responsive valve 35 as shown in FIG. 5 in place of the temperature-responsive valve 26 shown in FIG. 3.

The temperature-responsive valve 35 as shown in FIG. 5 includes a first bi-metal disc 36 and a second bi-metal disc 37. When the temperature of riser portion 31 remains below a predetermined temperature T2, then the bi-metal discs 36, 37 are both brought into intimate contact with the O-rings 38, 39, respectively, so that an inlet 41 of the valve 35 connected to the port 32 is not communicated with an outlet 42, and a vacuum at the port 32 is not introduced into the passage portion 33 connected to the outlet 42. Accordingly, exhaust gases are not recirculated.

When the temperature of a riser portion remains between the temperature T2 and a second higher predetermined temperature T3, the bi-metal disc 36 alone is detached from the O-ring 38. In this manner, a vacuum at port 32 is introduced via an orfice 43 into the outlet 42. As has been described earlier, according to the EGR control valve 6, the cross sectional area of the EGR passage 5 is not continuously varied or controlled in association with a vacuum supplied to the vacuum chamber 8, but the EGR passage 5 is opened or closed depending on a vacuum or atmospheric pressure supplied to the vacuum chamber 8, after being regulated by the vacuum-regulating valve 15. Accordingly, the time that a vacuum is supplied through the orifice 43 in the temperature-responsive valve 35 into the vacuum chamber 8 in the EGR control valve 6 is delayed, while the time of an atmospheric pressure being supplied via port 23 into the vacuum chamber 8 in the EGR control valve 6 is not delayed, with the result that the ratio of a period of the opening time of the valve port 13 per unit time is relatively small. In this manner, a less amount of exhaust gases is introduced into the intake manifold 3.

When the temperature of the riser portion 31 is above a temperature T3, the bi-metal disc 37 as well is detached from the O-ring 39. A vacuum is introduced into the passage portion 33 not by way of the orifice 43, so that a ratio of an opening time of the valve port 13 per unit time may be maintained at a normal ratio. In this manner, exhaust gases may be supplied to the intake manifold 3 in a normal amount.

As is apparent from the foregoing description of the exhaust gas recirculation system according to the present invention, the flow rate of exhaust gases being recirculated may be controlled in association with the temperature of the riser portion 31, i.e., an atomized condition of fuel which largely affects the operational performance of an engine.

While description has been given of an intake-mixture-charge heating device provided in an intake manifold, which is heated by exhaust gases, the exhaust gas recirculation system according to the present invention may be applied to an internal combustion engine equipped with an intake-mixture-charge heating device which utilizes warmed cooling water.

Although the present invention has been described with respect to specific details of certain embodiments thereof, it is not intended that such details be limitations upon the scope of the invention except insofar as set forth in the following claims.

What is claimed is:

1. An exhaust gas recirculation system in combination with an internal combustion engine having an intake mixture system and an exhaust manifold, the exhaust gas recirculation system comprising:

an intake manifold having a riser portion for heating an intake mixture charge;

an exhaust gas recirculation passage running from the exhaust manifold to the intake manifold for introducing part of exhaust gases from the former to the latter; and a temperature-responsive valve in said intake manifold directly responsive to the temperature of said riser portion for controlling the flow rate of exhaust gases from said exhaust manifold through said exhaust gas recirculation passage into said intake manifold in accordance with the temperature of said riser portion.

2. An exhaust gas recirculation system as set forth in claim 1 wherein the intake mixture system includes a carburetor having an air horn and a throttle valve positioned therein and wherein said exhaust gas recirculation system also includes:

an exhaust gas recirculation port in the air horn of the carburetor, said port being located proximate the throttle valve for being exposed to a vacuum or atmospheric pressure according to the position of the throttle valve;

a vacuum-sensitive exhaust gas recirculation valve in said exhaust gas recirculation passage, said exhaust gas recirculation valve being under bias toward closure, and a passage for applying the vacuum or atmospheric pressure appearing at said port to said exhaust gas recirculation valve for respectively opening the latter valve, or allowing it to close under bias, said temperature-responsive valve being in said passage.

3. An exhaust gas recirculation system as set forth in claim 2 wherein said exhaust gas recirculation valve includes a valve port and vacuum-sensitive valve body means controlling said port, a vacuum chamber directly connected to said passage and a constant-pressure chamber positioned between said valve port and said exhaust manifold; and a pressure-sensitive vacuum-regulating valve having an atmospheric pressure chamber connected to said passage between said temperature-responsive valve and said vacuum chamber, a control chamber connected to said constant-pressure chamber, said latter valve being biased open for admitting atmospheric pressure to said passage and being closed against bias by pressure developing in said constant pressure chamber.

4. An exhaust gas recirculation system as set forth in claim 2, wherein said temperature-responsive valve includes a bi-metal disc and an O-ring cooperative therewith, said bi-metal disc being adapted to open said passage at a predetermined temperature and to close said passage at temperatures below said predetermined temperature.

5. An exhaust gas recirculation system as set forth in claim 2, wherein said temperature-responsive valve includes first and second bi-metal discs and two O-rings individually cooperative therewith, successively positioned for opening and closing said passage, said first bi-metal disc being responsive to one temperature range and said second bi-metal disc being responsive to another higher temperature range, and orifice means interconnecting portions of said passage upstream and downstream of said second bi-metal disc for by-passing the second disc when the temperature of said riser portion is below said higher temperature range.

* * * * *